US007516689B2

(12) United States Patent
Herman et al.

(10) Patent No.: US 7,516,689 B2
(45) Date of Patent: Apr. 14, 2009

(54) OPTIMIZED WEAPONS RELEASE MANAGEMENT SYSTEM

(75) Inventors: Carl R. Herman, Owego, NY (US); John O. Moody, Vestal, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 565 days.

(21) Appl. No.: 11/138,601

(22) Filed: May 26, 2005

(65) Prior Publication Data

US 2006/0266203 A1 Nov. 30, 2006

(51) Int. Cl.
*F41G 7/34* (2006.01)

(52) U.S. Cl. ..... 89/1.11

(58) Field of Classification Search ..... 89/1.11
See application file for complete search history.

(56) References Cited

U.S. PATENT DOCUMENTS

| | | | | |
|---|---|---|---|---|
| 5,150,857 | A | 9/1992 | Moffitt et al. | |
| 5,153,366 | A * | 10/1992 | Lucas | 89/1.11 |
| 5,378,155 | A | 1/1995 | Eldridge | |
| 5,419,513 | A | 5/1995 | Flemming, Jr. et al. | |
| 5,537,909 | A | 7/1996 | Schneider et al. | |
| 5,644,386 | A | 7/1997 | Jenkins et al. | |
| 5,992,288 | A * | 11/1999 | Barnes | 89/1.11 |
| 6,043,867 | A | 3/2000 | Saban | |
| 6,044,765 | A | 4/2000 | Regebro | |
| 6,064,942 | A | 5/2000 | Johnson et al. | |
| 6,122,572 | A | 9/2000 | Yavnai | |
| 6,154,693 | A | 11/2000 | Aberschitz et al. | |
| 6,208,248 | B1 | 3/2001 | Ross | |
| 6,260,797 | B1 | 7/2001 | Palmer | |
| 6,270,038 | B1 | 8/2001 | Cycon et al. | |
| 6,484,072 | B1 | 11/2002 | Anderson et al. | |
| 6,653,971 | B1 | 11/2003 | Guice et al. | |
| 2002/0070315 | A1 | 6/2002 | Hilliard et al. | |
| 2003/0004644 | A1 | 1/2003 | Farmer | |
| 2004/0102876 | A1 | 5/2004 | Doane | |
| 2004/0134337 | A1 | 7/2004 | Solomon | |

FOREIGN PATENT DOCUMENTS

WO WO 9928696 6/1999

OTHER PUBLICATIONS

"X-45 Unmanned Combat Air Vehicle", source(s): fas.org.
"Rafael Unveils Protector Unmanned Surface Vehicle (USV) for Force Protection and Homeland Defense", source(s): Rafael.
"The Problematic Nexus: Where Unmanned Combat Air Vehicles and the Law of Armed Conflict Meet", source(s): Air & Space Power Chronicles.
"Future Weapons", source(s): USAF.
"Ground Based Air Defence", source(s): armedforces.co.uk.

* cited by examiner

*Primary Examiner*—Stephen M Johnson
(74) *Attorney, Agent, or Firm*—Tarolli, Sundheim, Covell & Tummino LLP

(57) ABSTRACT

A system determines an optimal weapon release condition of an attack vehicle engaging a target. The system includes a portion for determining the optimal weapon release condition by comparing the probability of killing the target to the probability of the attack vehicle being killed.

15 Claims, 4 Drawing Sheets

OPTIMIZED WEAPONS RELEASE MANAGEMENT SYSTEM

GOVERNMENT RIGHTS

This invention was made with Government support under Agreement No. MDA972-02-9-0011 awarded by DARPA. The Government has certain rights in the invention.

FIELD OF INVENTION

The present invention relates to weapons systems, and more specifically, to a system for optimizing weapons release.

BACKGROUND OF THE INVENTION

There are a variety of attack vehicles (AVs) that may employ weapons systems. Attack vehicles include ground vehicles, such as tanks and armored personnel carriers. Attack vehicles also include aircraft, such as jets and rotary propelled airplanes. Attack vehicles further include airborne rotocraft, such as helicopters, and watercraft, such as gunboats. These attack vehicles may be manned, for example, by personnel, such as drivers, pilots, or captains. Alternatively, these attack vehicles may be unmanned vehicles, such as unmanned ground based vehicles or unmanned aerial vehicles (UAVs). Unmanned vehicles may be controlled by remote operations personnel or may be autonomous, carrying out a mission with little or no human control or intervention.

Attack vehicles may employ one or more weapon systems. When an attack vehicle encounters a target, a determination is made as to the type of target and the threat the target poses. In a manned attack vehicle or remote operator controlled unmanned vehicle, this determination may be performed through human (e.g., driver or pilot) recognition, sensor recognition, e.g., automatic target recognition (ATR), or a combination of human recognition and sensor recognition. The determined target type may help determine which attack vehicle weapon system is selected to engage the target.

For a particular type of target, the attack vehicle possesses a probability of killing the target ($P_{kill_target}$) and the target possesses a probability of killing the attack vehicle ($P_{kill_AV}$) The probability of killing the target $P_{kill_target}$ and the probability of the attack vehicle being killed $P_{kill_AV}$ both vary as a function of the range between the attack vehicle and the target. Generally speaking, $P_{kill_target}$ for a particular weapon system increases as the range between the attack vehicle and the target decreases. On the other hand, $P_{kill_AV}$ also increases as the range between the attack vehicle and the target decreases.

SUMMARY OF THE INVENTION

In accordance with the present invention, a system determines an optimal weapon release condition of an attack vehicle engaging a target by comparing the probability of killing the target to the probability of the attack vehicle being killed. In accordance with an other aspect of the present invention, a computer program product determines an optimal weapon release condition of an attack vehicle engaging a target by comparing the probability of killing the target to the probability of the attack vehicle being killed.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF AN EXAMPLE EMBODIMENT

Figure 1:
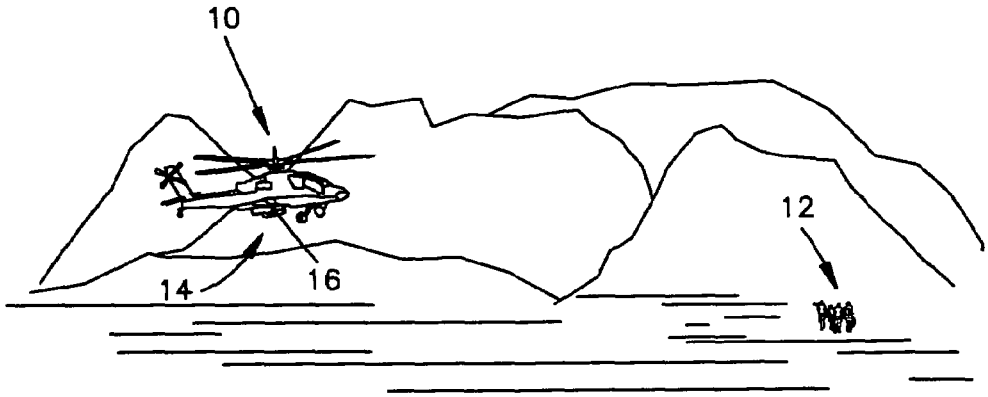
FIG. 1 illustrates a battlefield scenario including a target and an attack vehicle equipped with a weapons release management system according to the present invention.

Referring to FIG. 1, the present invention relates to attack vehicles 10 that engage targets 12. The attack vehicles 10 may be any known military or combat vehicle, manned or unmanned. In the illustration of FIG. 1, the attack vehicle 10 is an airborne rotocraft, e.g., an attack helicopter. The targets 12 may be any known enemy target, such as artillery, vehicles, ground troops or a combination of these enemy targets. In the illustration of FIG. 1, the targets 12 are ground troops. The attack vehicle 10 is fit with a weapon system 14 that includes one or more weapons 16, such as guns or rocket launchers.

For a given weapon system 14, there is a finite range within which that particular weapon type is lethal against a particular target 12, i.e., a lethality range. For example, where the weapon system 14 is a gun 16, the lethality range may be several hundred meters. As another example, where the weapon 16 is a rocket launcher, the lethality range may be several kilometers. The type of target 12 may also have some bearing on the lethality range for a particular weapon system 14. For example, where the weapon 16 is a gun and the target 12 is an armored vehicle, the gun may be less effective, effective only within close range, or ineffective.

Figure 2:
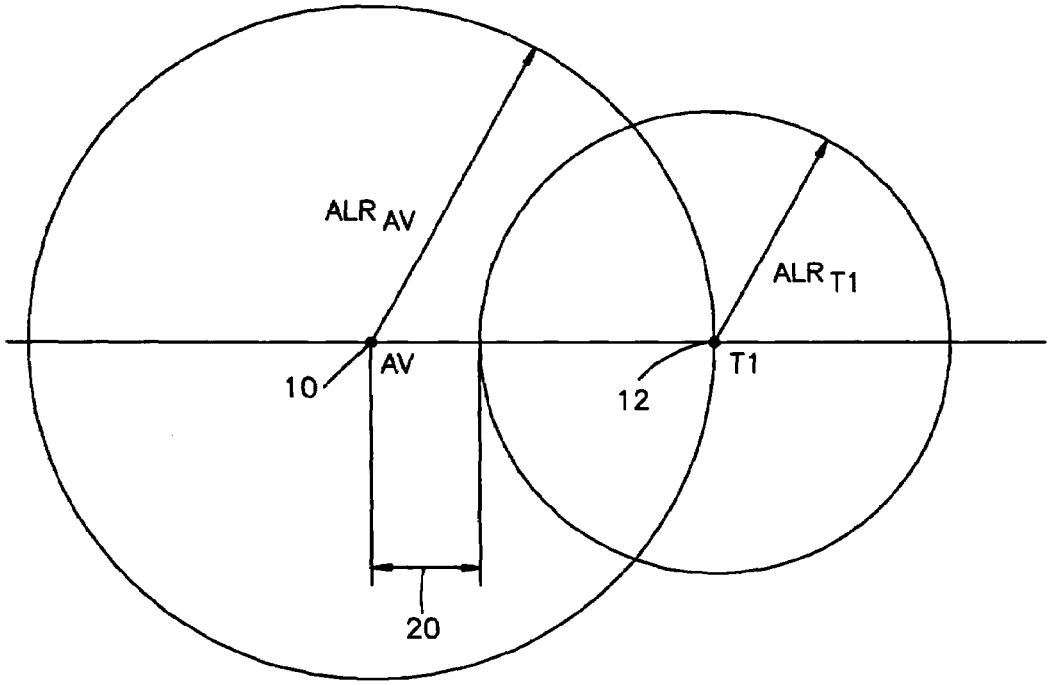
FIG. 2 is a schematic representation of relative positions and lethality ranges for the target and attack vehicles of FIG. 1.

Referring to FIG. 2, for a given target 12, indicated at T1, there is an average lethality range ($ALR_{T1}$). The average lethality range $ALR_{T1}$ is the average range within which the target 12 is likely to be lethal against a particular attack vehicle 10. Also, for a given attack vehicle 10, there is an average lethality range ($ALR_{AV}$). The average lethality range $ALR_{AV}$ is the average range within which the attack vehicle 10 is likely to be lethal against a particular target 12. Together, the average lethality ranges $ALR_{AV}$ and $ALR_{T1}$ define a lethality standoff margin 20.

The lethality standoff margin 20 is related to a lethality standoff ratio (LSR) for the attack vehicle 10 versus the target 12. The lethality standoff ratio can be expressed in terms of the average lethality ranges of the attack vehicle 10 and the target 12, $ALR_{AV}$ and $ALR_{T1}$, respectively, according to the following equation:

$$LSR_{AV-TI} = \frac{ALR_{AV}}{ALR_{TI}} \qquad \text{Equation 1}$$

As shown in Equation 1, if the lethality standoff ratio $LSR_{AV_T1}$ is greater than one, the attack vehicle 10 has an overall engagement advantage against the target 12. As the degree to which the lethality standoff ratio $LSR_{AV\text{-}T1}$ increases beyond one, the advantage the attack vehicle 10 has against the target 12 also increases. Conversely, if the lethality standoff ratio $LSR_{AV\text{-}T1}$ is less than one, the attack vehicle 10 has an overall engagement disadvantage against the target 12. As the lethality standoff ratio $LSR_{AV\text{-}T1}$ approaches zero, the overall engagement disadvantage of the attack vehicle 10 increases.

Figure 3:
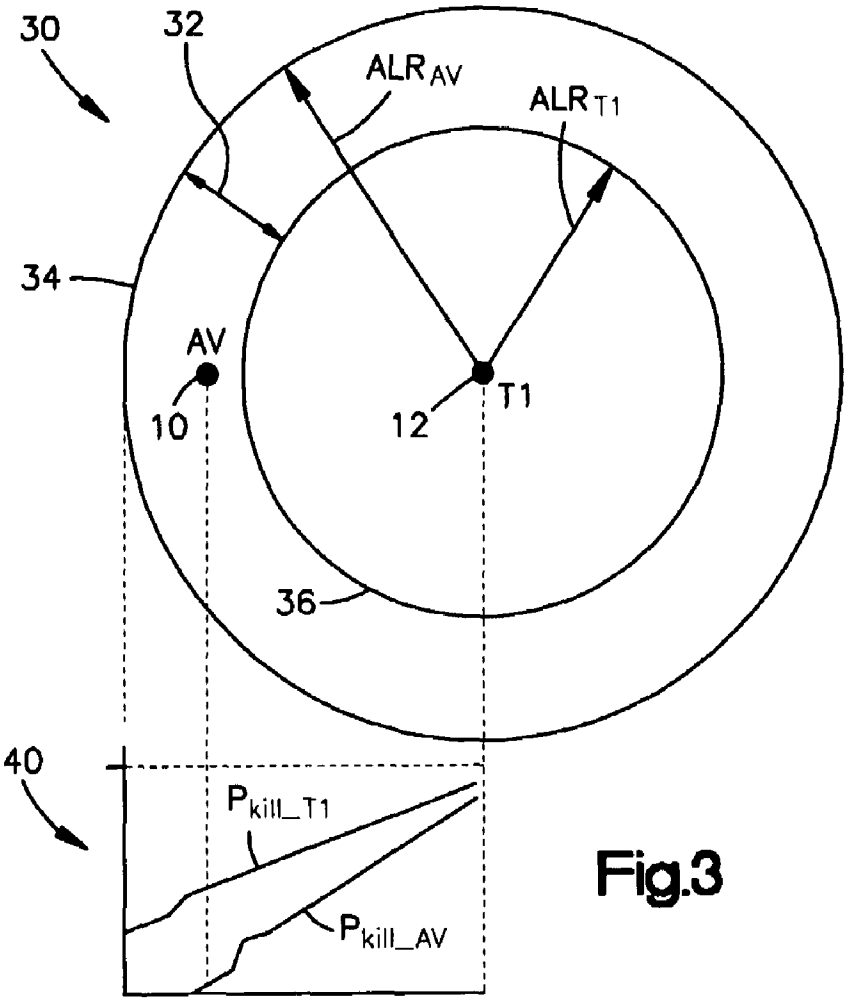
FIG. 3 is a schematic representation of a standoff region and respective kill probabilities for the target and attack vehicles of FIG. 1.

The impact of the lethality standoff ratio $LSR_{AV\text{-}T1}$ is illustrated in a standoff diagram portion 30 of FIG. 3. As shown in the standoff diagram 30 FIG. 3, a standoff region 32 is defined by superimposing the average lethality ranges $ALR_{T1}$ and $ALR_{AV}$ over the target 12. The standoff region 32 is an area within which the attack vehicle 10 is likely capable of killing the target 12 and the target is likely incapable of killing the attack vehicle. The standoff region 32 thus may define a preferred region in which it may be desirable for the attack vehicle 10 to engage the target 12. In this description, use of the term "kill" is meant to describe a condition where the subject (e.g., an attack vehicle or target) is placed in a condition of no military significance.

Within the standoff region 32, an optimal survivability standoff region 34 is defined near the outer perimeter of the standoff region. The optimal survivability standoff region 34 is the portion of the standoff region 32 where the probability of the attack vehicle being killed ($P_{kill_AV}$) is smallest. In the optimal survivability stand off region 34, however, the probability of killing the target ($P_{kill_T1}$) is also the smallest within the standoff region 32.

Within the standoff region 32, an optimal weapons standoff region 36 is defined near the inner perimeter of the standoff region. The optimal weapons standoff region 36 is the portion of the standoff region 32 where the probability of killing the target $P_{kill_T1}$ is the greatest. In the optimal weapons stand off region 36, however, the probability of the attack vehicle being killed $P_{kill_AV}$ is also the greatest within the standoff region 32.

The relationship of $P_{kill_AV}$ and $P_{kill_T1}$ to the relative physical positions of the attack vehicle 10 and target 12 is illustrated in the kill probability plot 40 of FIG. 3. The kill probability plot 40 of FIG. 3 plots $P_{kill_AV}$ and $P_{kill_T1}$ versus the range between the attack vehicle 10 and the target 12. The dashed lines linking the standoff diagram 30 and the kill probability plot 40 illustrate how $P_{kill_AV}$ and $P_{kill_T1}$ vary as a function of range.

As shown in the kill probability plot 40, as the attack vehicle 10 closes in on the target 12, i.e., as the range gets smaller, the $P_{kill_AV}$ and $P_{kill_T1}$ increase, at disproportionate rates. These disproportionate rates, illustrated by the curves for $P_{kill_AV}$ and $P_{kill_T1}$ in FIG. 3, may vary depending on a variety of factors. For example, the vehicle types of the attack vehicle 10 and the target 12, the weapon systems employed by the attack vehicle and the target, the type of terrain in which the attack vehicle engages the target, or a combination of these factors, may account for the disproportionate rates.

For the position of the attack vehicle 10 shown in FIG. 3, the difference between $P_{kill_T1}$ and $P_{kill_AV}$ is relatively high. This indicates that there is a relatively small chance of the attack vehicle 10 killing the target 12 and a comparatively very small chance of the attack vehicle being killed by the target. As shown in FIG. 3, to increase the chance of success in killing the target 12, i.e., to improve $P_{kill_T1}$, the attack vehicle 10 may undergo a sacrifice in $P_{kill_AV}$.

According to the present invention, a weapons release management system 50 determines an optimal weapon release condition through the implementation of mathematical criterion that utilizes the values of $P_{kill_T1}$ and $P_{kill_AV}$. According to one aspect of the present invention, the mathematical criterion implemented by the weapons release management system 50 comprises a determination of the optimal weapon release condition when the difference between $P_{kill_T1}$ and $P_{kill_AV}$ with respect to range is maximized. In one particular embodiment, the optimal weapon release condition is determined when the first derivative of the difference between $P_{kill_T1}$ and $P_{kill_AV}$ with respect to range equals zero, that is:

$$\frac{d(P_{\text{kill_T1}} - P_{\text{kill_AV}})}{dR} = 0 \qquad \text{Equation 2}$$

Those skilled in the art will appreciate that the mathematical criterion utilizing the values of $P_{kill_T1}$ and $P_{kill_AV}$ may take various forms. For example, the optimal weapons release condition may be determined based on a probability of kill threshold. In this instance, instead of comparing the difference between $P_{kill_T1}$ and $P_{kill_AV}$, the determination of the optimal weapons release condition is made when one of the values for $P_{kill_T1}$ and $P_{kill_AV}$ reaches a predetermined threshold. For example, the optimal weapon release condition may be determined when $P_{kill_AV}$ reaches a predetermined value, such as 5%, regardless of the value for $P_{kill_T1}$. As another example, the optimal weapon release condition may be determined when $P_{kill_T1}$ reaches a predetermined value, such as 75%, regardless of the value for $P_{kill_AV}$.

Other examples of the mathematical criterion that may be used to determine the optimal weapons release condition are known mathematical criterion or algorithms. For example, those skilled in the art will appreciate that Newton's methods, least squares methods, or discrete subtraction algorithms may be used to determine the optimal weapons release condition based on values for $P_{kill_T1}$ and $P_{kill_AV}$.

From the above, it will be appreciated that the optimal weapon release condition determination performed by the weapons release management system 50 can be initiated and carried out in a variety of manners. For Example, once the target 12 is identified, the weapons release management system 50 may determine the optimal range at which to engage the target, given the weapons available to the attack vehicle 10 and the identity of the target. This optimal range may be determined using any of the various mathematical criterion described above. For example, using the first derivative criterion of Equation 2, the optimal range may be determined as being when the difference between $P_{kill_T1}$ and $P_{kill_AV}$ is the greatest or within an optimal range in the lethality standoff region 36 for the attack vehicle 10 and target 12. When the optimal range is achieved, the weapons release management system 50 may then indicate the optimal weapon release condition.

It will further be appreciated that the determination of the optimal weapon release condition may be used in a variety of manners. For example, in an attack vehicle 10 manned by personnel, an indication of the optimal weapon release condition may be provided as information that the personnel can use along with other information, such as that provided by sensor recognition, to help make weapon release determinations. As another example, in an unmanned vehicle, such as the UAV 10, determination of the optimal weapon release condition may form a portion of a decision-making routine, such as a model, decision matrix or decision tree, that automatically makes weapon release determinations. As another example, in an unmanned vehicle, such as the UAV 10, an indication of the optimal weapon release condition may be provided as information that remote operations personnel can use to help make weapon release determinations for the unmanned vehicle. As a further example, in an unmanned vehicle, such as the UAV 10, determination of the optimal weapon release condition may be the sole determining factor as to when to release a weapon, once a determination to engage a target 12 has been made.

From the description thus far, it will be appreciated that, for any given engagement scenario between the attack vehicle 10 and the target 12, there is an associated risk that the target will kill the attack vehicle. Depending on the specifics of the particular engagement scenario, there may be an associated risk tolerance, i.e., a degree or amount of risk that the attack vehicle 10 is willing to tolerate. The risk tolerance for a particular attack vehicle 10 in a particular engagement scenario varies, depending on a variety of factors. For example, the risk tolerance may vary depending on the importance or criticality of the mission in which the engagement scenario takes place. As another example, the risk tolerance may vary depending on whether the attack vehicle 10 is manned or unmanned. In a manned attack vehicle 10, the risk of losing on-board human life is involved in determining the risk tolerance. In an unmanned aerial vehicle 10, because on-board human life is not a concern, risk tolerance can become more of a question of the risk of life for other mission team members, impact to mission objectives, and risk of monetary loss.

According to an alternative embodiment of the present invention, the weapons release management system 50 may implement a risk factor, $k_{risk}$, to allow for adjusting or tuning determination of the optimal weapon release condition to reflect a risk tolerance associated with a particular target or mission. For example, in the embodiment where the optimal weapon release condition is determined when the first derivative of the difference between the risk factor weighted $P_{kill_T1}$ and $P_{kill_AV}$ with respect to range equals zero, $k_{risk}$ may be implemented as follows:

$$\frac{d(k_{risk}P_{\text{kill_T1}} - P_{\text{kill_AV}})}{dR} = 0 \qquad \text{Equation 3}$$

As shown in Equation 3, the risk factor, $k_{risk}$, can be adjusted to tailor or weight the equation to a determined risk tolerance. As $k_{risk}$ increases, the more risk will be taken to ensure that the target T1 is killed. As $k_{risk}$ decreases, the more A1 is removed from the risk of being killed. It will be appreciated that Equation 3 can be made equivalent to Equation 2 simply by implementing a risk factor $k_{risk}$ of one (1.0).

Figure 4:
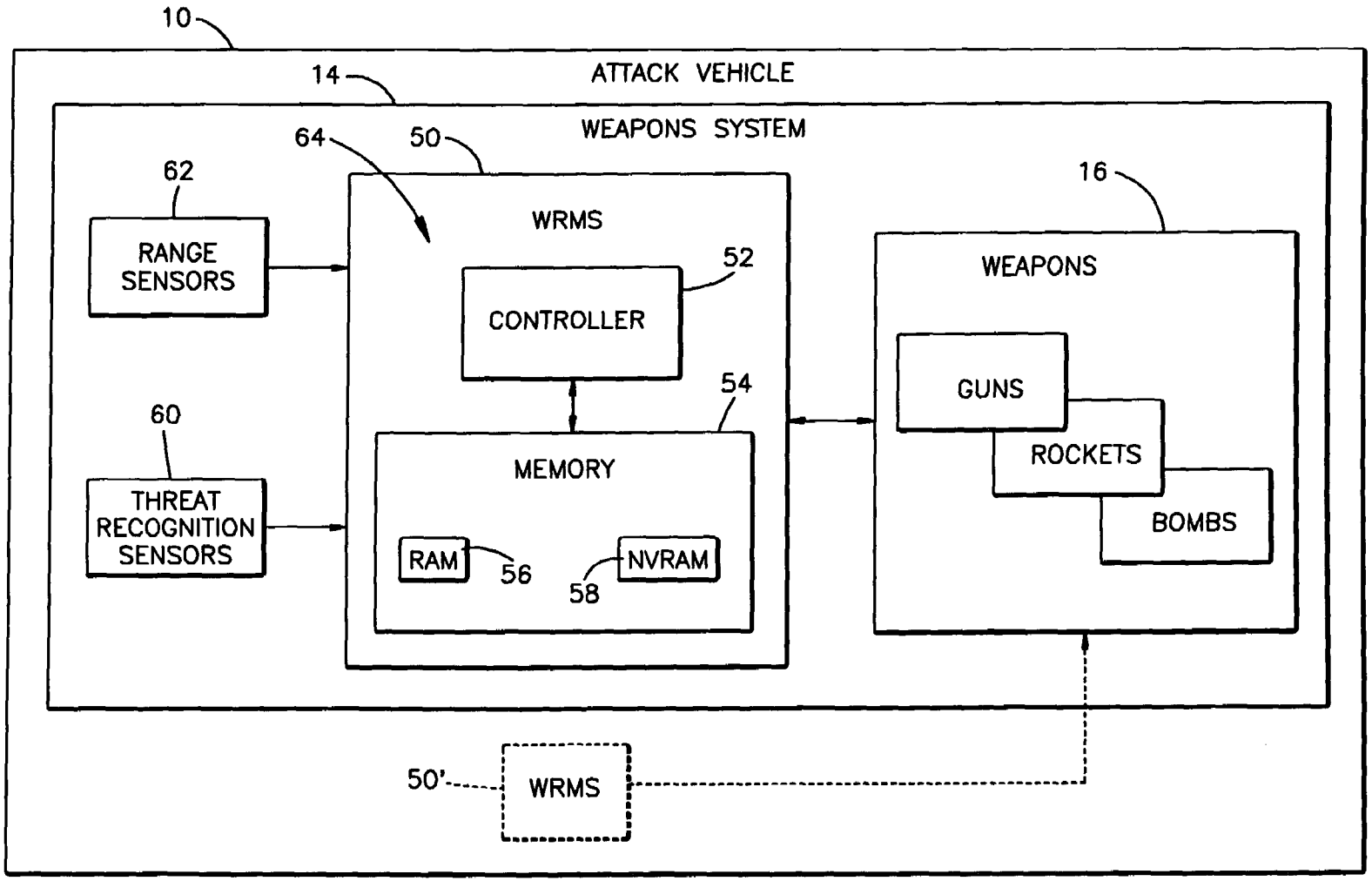
FIG. 4 is a schematic representation of an example weapons release management system according to the present invention.

Referring to FIG. 4, a weapons release management system (WRMS) 50 for determining an optimal weapons release condition is implemented as a portion or module of the weapons system 14 of the attack vehicle 10. The weapons release management system 50 could, however, be implemented in any suitable manner. For example, as shown at 50' in FIG. 4, the weapons release management system may be implemented as a standalone system or sub-system on the attack vehicle 10 configured to communicate or otherwise provide data to the weapons system 14 or any other desired system of the attack vehicle 10.

The weapons system 14 of the attack vehicle 10 may also include one or more target recognition sensors 60, such as an automatic target recognition (ATR) sensor. The weapons system 14 may further include one or more range sensors 62, such as RADAR or laser radar (LADAR) range sensors. The target recognition sensors 60 and range sensors 62 are operative to provide data to the WRMS 50 relating to target type (e.g., mounted/dismounted or ground troops/vehicle) and range between the attack vehicle 10 and the target 12.

The WRMS 50 includes a computer platform 64 for performing the functions described herein. The computer platform 64 may have any configuration suited to perform these functions. In the example configuration of FIG. 4, the computer platform 64 of the WRMS 50 includes a controller 52 and memory 54. The memory 54 may include random access memory (RAM) 56, non-volatile random access memory (NVRAM) 58, such as an electronically erasable programmable read only memory (EEPROM), or any other memory or data storage medium. The controller 52 may include one or more electronic devices suited to perform the control functions of the WRMS 50 described herein. For example, the controller 52 may include one or more microcontrollers, microprocessors, state machines, discrete components, one or more application specific integrated circuits ("ASIC"), field programmable gate arrays (FPGAs), or a combination of these devices.

The WRMS 50 may be adapted in any suitable manner to perform the weapons release management functions in accordance with the description provided herein. For example, the WRMS 50 may be configured and adapted to execute an executable computer program product that includes instructions for performing weapons release management functions. For instance, referring to the example computer platform configuration of the WRMS 50 in FIG. 4, the controller 52 may execute instructions of a computer program stored in NVRAM 56 to perform the desired weapons release management functions. In doing so, the controller 52 may utilize program data stored the RAM 58, and information provided by the target recognition sensors 60 and range sensors 62.

The memory 54, e.g., the NVRAM 56, is loaded with program data that the WRMS 50 draws upon in determining the optimal weapon release condition. The data may include, for example, $P_{kill_T1}$, $P_{kill_AV}$, $ALR_{T1}$, and $ALR_{AV}$. The data may be arranged in any format suited for access by the WRMS 50. For example, the data may be arranged in a database, such as a look-up table.

The database stored in memory 54 is populated with statistical data (e.g., $P_{kill_T1}$, $P_{kill_AV}$, $ALR_{T1}$, and $ALR_{AV}$) regarding potential battlefield engagement scenarios. This statistical data may be derived from a variety of sources. For example, the statistical data may be derived from computer simulated battlefield engagement scenarios, actual simulated battlefield engagement scenarios (e.g., war games), field studies, case studies, historical data, empirical data, and any other source from which statistical data regarding a battlefield engagement scenario may be obtained.

In one particular embodiment, the database stored in memory 54 is populated with $P_{kill_T1}$ data and $P_{kill_AV}$ data. The individual values for $P_{kill_T1}$ and $P_{kill_AV}$ are associated with values for the range between the attack vehicle 10 and the target 12. The individual values for $P_{kill_T1}$ and $P_{kill_AV}$ may also be associated with the various different types of weapons available to the attack vehicle 10. Thus, when the attack vehicle 10 identifies a target 12, the WRMS 50 can retrieve $P_{kill_T1}$ and $P_{kill_AV}$ from the database based on the range to the target and, if necessary, the weapon type used by the attack vehicle. Similarly, when the attack vehicle 10 identifies a target 12, the WRMS 50 can retrieve from the database the range at which $P_{kill_T1}$ is optimal over $P_{kill_AV}$. If necessary, the WRMS 50 may also take into account the weapon type used by the attack vehicle 10 in retrieving this range.

For example, consider a battlefield engagement scenario in which an attack vehicle 10 in the form of an attack helicopter engages a target 12 in the form of ground troops. In this scenario, the attack helicopter includes weapons in the form of guns and missiles. Once the target 12 is identified, using the database, the WRMS 50 can look-up the range at which the difference between $P_{kill_T1}$ and $P_{kill_AV}$ is maximized if using missiles to engage the target. The WRMS 50 can also look-up the range at which the difference between $P_{kill_T1}$ and $P_{kill_AV}$ is maximized if using guns to engage the target. The WRMS 50 can then provide these optimal weapon release conditions to the pilot of the attack helicopter.

As another example, in the battlefield engagement scenario described in the preceding paragraph, the WRMS 50 may determine the optimal weapon release conditions using the derivatives set forth in equations 2 and 3 above. To do so, the WRMS 50 evaluates the difference between $P_{kill_}$T1 and $P_{kill_AV}$ with respect to range as the attack vehicle 10 engages the target 12. When the equation equals zero, by definition, the difference between $P_{kill_T1}$ and $P_{kill_AV}$ is maximized, indicating the optimal weapon release condition, which the WRMS 50 can then provide to the pilot of the attack helicopter.

Figure 5:
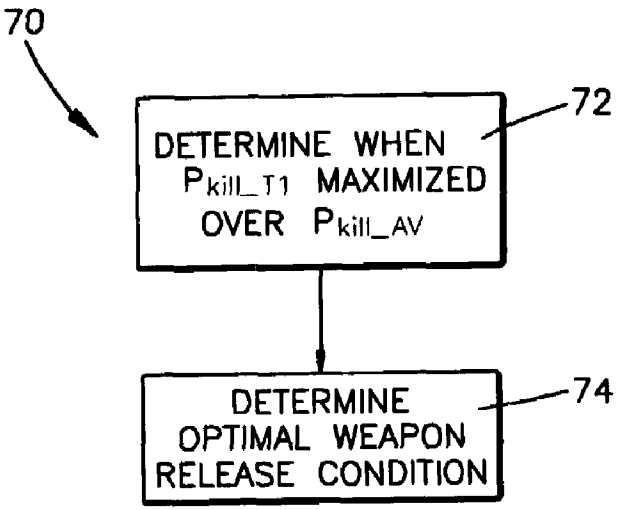
FIGS. 5-7 are flow diagrams illustrating processes and computer implemented instructions performed by the weapons release management system of FIG. 4.

An example of a weapons release management process performed by the weapons system 14 is illustrated in the diagram of FIG. 5. In this description, the steps or functions of the process illustrated in FIG. 5 are arranged and described in a sequence or order that is not meant to limit the scope of the invention. Certain steps or functions of the process shown in FIG. 5 and described herein may be performed, alone or in part, in any order or simultaneously.

The process 70 includes the step 72 of determining when the probability of killing the target ($P_{kill_T1}$) is maximized over the probability of the attack vehicle being killed ($P_{kill_AV}$). The process 70 also includes the step 74 of determining an optimal weapon release condition in response to the determination of step 72. According to the present invention, one particular manner by which the determination of step 72 can be performed is by evaluating the derivative of Equation 2 using values for $P_{kill_T1}$, $P_{kill_AV}$, and range. Alternatively, where a risk factor ($k_{risk}$) is implemented, the determination of step 72 can be performed by evaluating the derivative of Equation 3.

In the context of the computer executed instructions performed by the WRMS 50, FIG. 5 also illustrates a computer program product 70 that includes an instruction 72 for determining when the probability of killing the target ($P_{kill_T1}$) is maximized over the probability of the attack vehicle being killed ($P_{kill_AV}$). The computer program product 70 also includes an instruction 74 for determining an optimal weapon release condition in response to the determination of instruction 72. According to the present invention, in one particular embodiment, the instruction 72 may evaluate the derivative of Equation 2 using values for $P_{kill_T1}$, $P_{kill_AV}$, and range. Alternatively, where a risk factor ($k_{risk}$) is implemented, the instruction 72 may evaluate the derivative of Equation 3.

Figure 6:
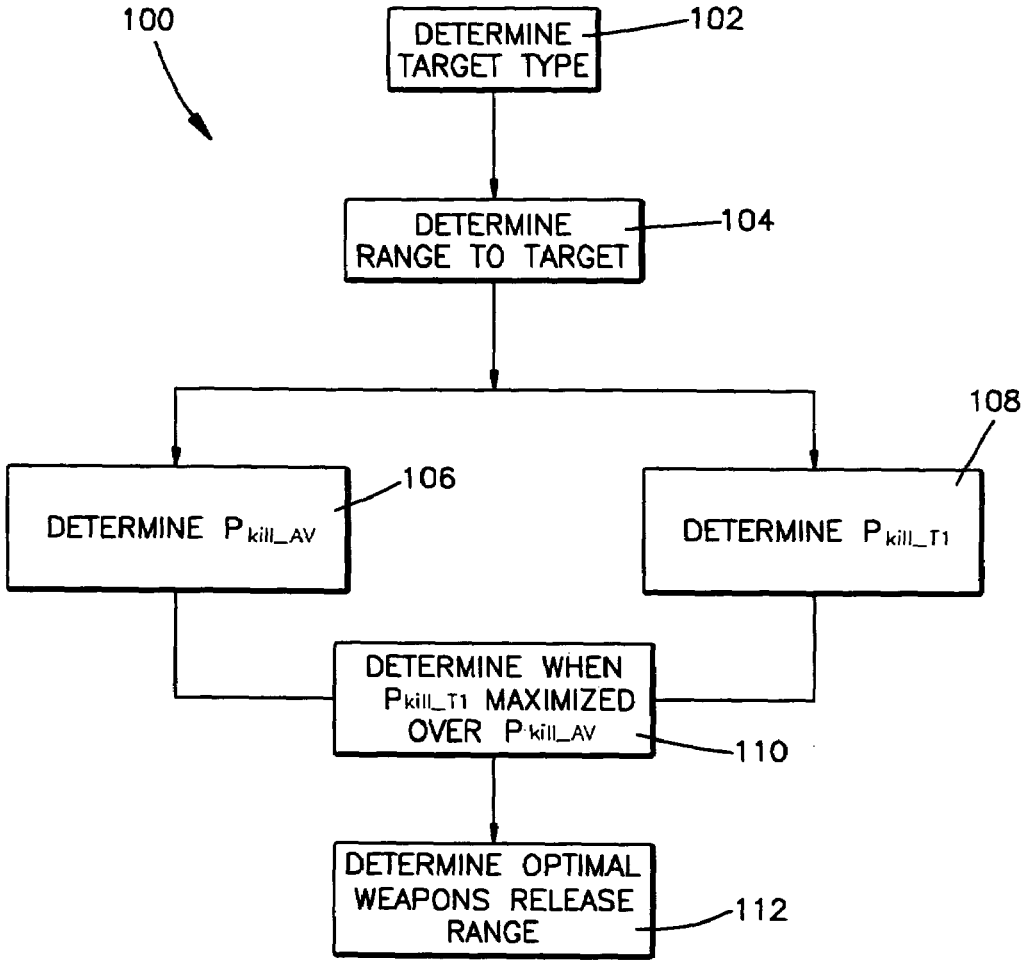

An example of a weapons release management process performed by the weapons system 14 is illustrated in greater detail in the diagram of FIG. 6. In this description, the steps or functions of the process illustrated in FIG. 6 are arranged and described in a sequence or order that is not meant to limit the scope of the invention. Certain steps or functions of the process shown in FIG. 6 and described herein may be performed, alone or in part, in any order or simultaneously.

The process 100 includes the step 102 of determining a target type. The process 100 also includes the step 104 of determining a range to the target. The process 100 also includes the step 106 of determining $P_{kill_AV}$ and the step 108 of determining $P_{kill_T1}$. As described above, $P_{kill_AV}$ and $P_{kill_T1}$ may be determined by selecting values from a database or look-up table given the range between the attack vehicle 10 and the target 12 and the weapon type used to engage the target. The process 100 also includes the step 110 of determining when $P_{kill_T1}$ is maximized over $P_{kill_AV}$. The process 100 further includes the step 112 of determining the optimal weapons release range in response to the determination of step 110.

Figure 7:
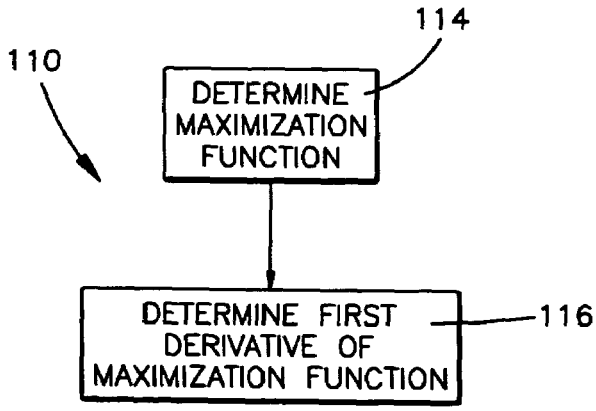

Referring to FIG. 7, step 110 may include the step 114 of determining a maximization function. The maximization function may be determined in accordance with either of Equations 2 and 3. The step 110 may also include the step 116 of determining the first derivative of the maximization function determined at step 114. In this scenario, the optimal weapons release range determined at step 112 of the process of FIG. 6 would be determined in response to the first derivative determination of step 116.

In the context of the computer implemented instructions performed by the WRMS 50, FIG. 6 also illustrates a computer program product 100 that includes an instruction 102 determining a target type. The computer program product 100 also includes an instruction 104 for determining a range to the target. The computer program product 100 also includes an instruction 106 for determining $P_{kill_AV}$ and an instruction 108 for determining $P_{kill_T1}$. As described above, $P_{kill_AV}$ and $P_{kill_T1}$ may be determined through instructions for selecting values from a database or look-up table given the range between the attack vehicle 10 and the target 12 and the weapon type used to engage the target. The computer program product 100 also includes an instruction 110 for determining when $P_{kill_T1}$ is maximized over $P_{kill_AV}$. The computer program product 100 further includes an instruction 112 for determining the optimal weapons release range in response to the determination of the instruction 110.

In the context of the computer implemented instructions performed by the WRMS 50, FIG. 7 also illustrates the instruction 110 of the computer program product 100 of FIG. 6. The instruction 110 includes an instruction 114 for determining a maximization function. The maximization function may be determined in accordance with either of Equations 2 and 3. The instruction 110 may also include an instruction 116 for determining the first derivative of the maximization function determined at the instruction 114. In this scenario, the optimal weapons release range determined at the instruction 112 of the computer program product 100 of FIG. 6 would be determined in response to the first derivative determination of instruction step 116.

It will be appreciated that the description of the present invention set forth above is susceptible to various modifications, changes and adaptations, and the same are intended to be comprehended within the meaning and range of equivalents of the appended claims. The presently disclosed embodiments are considered in all respects to be illustrative, and not restrictive. The scope of the invention is indicated by the appended claims, rather than the foregoing description, and all changes that come within the meaning and range of equivalence thereof are intended to be embraced therein.

Having described the invention, we claim:

1. A weapon system for determining an optimal weapon release condition of an attack vehicle engaging a target, the system comprising:

a weapon a portion for determining an optimal weapon release condition of the weapon by comparing the probability of killing the target to the probability of the attack vehicle being killed, the portion for determining the optimal weapon release condition comprising a portion for determining the range at which the difference between the probability of killing the target and the probability of the attack vehicle being killed is optimal.

2. The weapon system recited in claim 1, wherein the portion for determining the optimal weapon release condition comprises a portion for determining when the difference between the probability of killing the target and the probability of the attack vehicle being killed is optimal.

3. The weapon system recited in claim 1, further comprising:

a portion for determining the probability of killing the target based on the range between the attack vehicle and the target; and a portion for determining the probability of the attack vehicle being killed based on the range between the attack vehicle and the target.

4. The weapon system recited in claim 3, wherein:

the portion for determining the probability of killing the target comprises a look-up table that associates the probability of killing the target with the range between the attack vehicle and the target; and the portion for determining the probability of the attack vehicle being killed comprises a look-up table that associates the probability of the attack vehicle being killed with the range between the attack vehicle and the target.

5. The weapon system recited in claim 4, wherein the look-up table for selecting the probability of killing the target and the look-up table for selecting the probability of the attack vehicle being killed are populated with statistical data regarding potential battlefield engagement scenarios.

6. The weapon system recited in claim 1, wherein the portion for determining the optimal weapon release condition comprises a portion for implementing a mathematical criterion for evaluating the probability of killing the target and the probability of the attack vehicle being killed.

7. The weapon system recited in claim 6, wherein the mathematical criterion comprises an evaluation of the first derivative of the difference between the probability of the attack vehicle being killed and the probability of killing the target with respect to the range between the attack vehicle and the target.

8. The weapon system recited in claim 6, wherein the mathematical criterion comprises an evaluation of a probability of kill threshold.

9. The weapon system recited in claim 6, wherein the mathematical criterion comprises one of a Newtonian method, a least squares method, and a discrete subtraction algorithm based on values for $P_{kill_T1}$ and $P_{kill_AV}$.

10. The weapon system recited in claim 1, further comprising a portion for applying a risk tolerance factor to the optimal weapon release condition determination.

11. The weapon system recited in claim 10, wherein the risk tolerance factor is adjustable.

12. A weapon system for determining an optimal weapon release condition of an attack vehicle engaging a target, the system comprising:

a weapon a portion for determining the probability of killing the target based on the range between the attack vehicle and the target;

a portion for determining the probability of the attack vehicle being killed based on the range between the attack vehicle and the target; and a portion for determining an optimal weapon release condition of the weapon by comparing the probability of killing the target to the probability of the attack vehicle being killed.

13. The weapon system recited in claim 12, wherein:

the portion for determining the probability of killing the target comprises a look-up table that associates the probability of killing the target with the range between the attack vehicle and the target; and the portion for determining the probability of the attack vehicle being killed comprises a look-up table that associates the probability of the attack vehicle being killed with the range between the attack vehicle and the target.

14. The weapon system recited in claim 13, wherein the look-up table for selecting the probability of killing the target and the look-up table for selecting the probability of the attack vehicle being killed are populated with statistical data regarding potential battlefield engagement scenarios.

15. A weapon system for determining an optimal weapon release condition of an attack vehicle engaging a target, the system comprising:

a weapon a portion for determining an optimal weapon release condition of the weapon by comparing the probability of killing the target to the probability of the attack vehicle being killed, the portion for determining the optimal weapon release condition comprising a portion for implementing a mathematical criterion for evaluating the probability of killing the target and the probability of the attack vehicle being killed, wherein the mathematical criterion comprises one of a Newtonian method, a least squares method, and a discrete subtraction algorithm based on values for $P_{kill_T1}$ and $P_{kill_AV}$.

* * * * *